US009806453B2

(12) United States Patent
Matsuura et al.

(10) Patent No.: US 9,806,453 B2
(45) Date of Patent: Oct. 31, 2017

(54) CONNECTOR HAVING A HOUSING WITH RESILIENT LOCKING PIECES

(71) Applicant: Sumitomo Wiring Systems, Ltd., Yokkaichi, Mie (JP)

(72) Inventors: Junya Matsuura, Mie (JP); Toshikazu Sakurai, Mie (JP)

(73) Assignee: SUMITOMO WIRING SYSEMS, LTD., Yokkaichi, Mie (JP)

( * ) Notice: Subject to any disclaimer, the term of this patent is extended or adjusted under 35 U.S.C. 154(b) by 0 days.

(21) Appl. No.: 15/427,138

(22) Filed: Feb. 8, 2017

(65) Prior Publication Data

US 2017/0256878 A1 Sep. 7, 2017

(30) Foreign Application Priority Data

Mar. 4, 2016 (JP) ..... 2016-041850

(51) Int. Cl.

| | |
|---|---|
| ***H01R 13/514*** | (2006.01) |
| ***H01R 13/506*** | (2006.01) |
| ***H01R 13/50*** | (2006.01) |
| ***H01R 13/74*** | (2006.01) |
| ***H01R 13/436*** | (2006.01) |

(52) U.S. Cl.

CPC ..... *H01R 13/506* (2013.01); *H01R 13/4362* (2013.01); *H01R 13/50* (2013.01); *H01R 13/743* (2013.01)

(58) Field of Classification Search

CPC ..... H01R 13/518; H01R 13/4362; H01R 13/6271; H01R 13/6582; H01R 13/74

USPC ..... 439/352, 353, 355, 544, 752

See application file for complete search history.

(56) References Cited

U.S. PATENT DOCUMENTS

| | | | | |
|---|---|---|---|---|
| 9,356,391 | B2 * | 5/2016 | Akagi | H01R 13/743 |
| 2007/0173089 | A1 * | 7/2007 | Murakami | H01R 13/743 439/157 |
| 2007/0173112 | A1 * | 7/2007 | Murakami | H01R 13/743 439/557 |
| 2008/0248697 | A1 * | 10/2008 | Whiteman | H01R 13/743 439/709 |
| 2008/0305672 | A1 * | 12/2008 | Kodama | H01R 13/6273 439/357 |
| 2009/0011632 | A1 * | 1/2009 | Ito | H01R 13/6272 439/357 |

(Continued)

FOREIGN PATENT DOCUMENTS

| | | |
|---|---|---|
| JP | 2015-69836 | 4/2015 |

*Primary Examiner* — Chandrika Prasad

(74) *Attorney, Agent, or Firm* — Gerald E. Hespos; Michael J. Porco; Matthew T. Hespos

(57) ABSTRACT

A waiting side housing (M) includes resilient locking pieces (15) and resilient contact pieces (18). Locks (16) of the resilient locking pieces (15) restrict a displacement of the waiting side housing (M) toward a complete holding position by being locked to a mounting hole (H) and are separated from the mounting hole (H) only by resilient deformation of the resilient locking pieces (15). Contact portions (19) of the resilient contact pieces (18) are in contact with the mounting hole (H) with the waiting side housing (M) located at a temporary holding position. If tapered surfaces (20) of the contact portions (19) are pressed by an edge part of the mounting hole (H), the resilient contact pieces (18) are resiliently deformed to separate the contact portions (19) from the mounting hole (H).

4 Claims, 12 Drawing Sheets

(56) References Cited

U.S. PATENT DOCUMENTS

| | | | | |
|---|---|---|---|---|
| 2009/0203124 | A1* | 8/2009 | Zhang | C07K 14/4748<br>435/325 |
| 2015/0222052 | A1* | 8/2015 | Akagi | H01R 13/6395<br>439/352 |

* cited by examiner

CONNECTOR HAVING A HOUSING WITH RESILIENT LOCKING PIECES

BACKGROUND

1. Field of the Invention

The invention relates to a connector.

2. Description of the Related Art

Japanese Unexamined Patent Publication No. 2015-069836 discloses a connector in which a fit-in side housing is connected to a waiting side housing mounted in a mounting hole of a panel. This waiting side housing is held at a temporary holding position with respect to the panel by locking a resiliently deflectable temporary holding means to an edge of the mounting hole. A temporary holding releasing means of the fit-in side housing resiliently deforms the temporary holding means and separates it from the edge of the mounting hole when the fit-in side housing is connected properly. The housings then are moved to a complete holding position while being kept in a properly connected state, and a grommet mounted on the fit-in side housing is held in close contact with the panel to make a clearance between the mounting hole and the housings watertight.

The temporary holding means remains deformed resiliently by the temporary holding releasing means with the housings properly connected. Thus, when the two housings are moved to the temporary holding position, such as for maintenance, the temporary holding means may not be locked reliably to the edge of the mounting hole without being sufficiently resiliently restored. If this occurs, the waiting side housing cannot be held at the temporary holding position.

The invention was completed based on the above situation and aims to enable a waiting side housing returned to a temporary holding position from a proper holding position to be held reliably at the temporary holding position.

SUMMARY

The invention relates to a connector with a waiting side housing that is mounted to penetrate through a mounting hole of a panel. The waiting side housing is displaceable between a temporary holding position and a complete holding position. A resilient locking piece is formed on the waiting side housing, and a lock formed on the resilient locking piece. The lock restricts displacement of the waiting side housing toward the complete holding position by locking to an edge of the mounting hole when the waiting side housing is at the temporary holding position. However, resilient deformation of the resilient locking piece separates the lock from the edge of the mounting hole. A resilient contact piece is formed on the waiting side housing, and a contact portion is formed on the resilient contact piece. The contact portion is configured to hold the edge of the mounting hole in the same direction as a displacing direction from the temporary holding position to the complete holding position with the waiting side housing at the temporary holding position. A tapered surface is formed on the contact portion and is oblique to the displacing direction of the waiting side housing. The tapered surface is pressed by the edge of the mounting hole and deforms the resilient contact piece in a direction to separate the contact portion from the edge of the mounting hole. A fit-in side housing is connectable to the waiting side housing. A lock releasing portion is formed on the fit-in side housing and is configured to resiliently deform the resilient locking piece when the fit-in side housing is connected to the waiting side housing.

The waiting side housing is held reliably at the temporary holding position by a locking action of the lock of the resilient locking piece and a contacting action of the contact portion of the resilient contact piece. When the two housings are connected, the lock releasing portion resiliently deforms the resilient locking piece. Therefore locking by the lock is released. If the two housings are pressed toward the complete holding position in this state, contact by the contact portion is released and the two housings are displaced to the complete holding position. Even if the resilient locking piece is restored insufficiently to have a small locking margin of the lock when the two housings are returned to the temporary holding position, the waiting side housing can be held reliably at the temporary holding position by the contact of the resilient contact piece.

The invention also is directed to a connector with a waiting side housing to be mounted to penetrate through a mounting hole of a panel. The connector is displaceable between a temporary holding position and a complete holding position. A resilient locking piece is formed on the waiting side housing and a lock is formed on the resilient locking piece. The lock is configured to restrict a displacement of the waiting side housing toward the complete holding position by being locked to an edge of the mounting hole with the waiting side housing located at the temporary holding position and to separate from the edge of the mounting hole only by resilient deformation of the resilient locking piece. A fit-in side housing is connectable to the waiting side housing. A lock releasing portion is formed on the fit-in side housing and is configured to resiliently deform the resilient locking piece when the fit-in side housing is connected to the waiting side housing. A pressing portion presses the resilient locking piece in a direction to increase a locking margin of the locking portion with the edge of the mounting hole in a state where the lock releasing portion is not interfering with the resilient locking piece.

According to this aspect of the invention, the waiting side housing is held at the temporary holding position by the locking action of the locking portion of the resilient locking piece. When the two housings are connected, the lock releasing portion resiliently deforms the resilient locking piece to release locking by the locking portion. Thus, if the two housings are pressed toward the complete holding position, they are displaced to the complete holding position. Even if the resilient locking piece does not restore resiliently a sufficient amount when the two housings are returned to the temporary holding position, the pressing portion presses the resilient locking piece in the process of separating the fit-in side housing from the waiting side housing. This causes a locking margin of the locking portion with the edge of the mounting hole to be increased so that the waiting side housing can be held reliably at the temporary holding position.

The connector may further include a pressing portion formed on the fit-in housing and capable of pressing the resilient locking piece in a direction to increase a locking margin of the locking portion with the edge of the mounting hole in a state where the lock releasing portion is not interfering with the resilient locking piece. According to this configuration, even if the resilient locking piece does not restore sufficiently when the two housings are returned to the temporary holding position, the pressing portion presses the resilient locking piece in the process of separating the fit-in side housing from the waiting side housing. Thus, the locking margin of the locking portion with the edge of the mounting hole is increased so that the waiting side housing can be held reliably at the temporary holding position.

A plurality of the resilient locking pieces may be arranged at positions point-symmetrical with respect to a virtual center axis parallel to a connecting direction of the waiting side housing and the fit-in side housing. According to this configuration, there is no possibility that the two housings are inclined with respect to each other when the lock releasing portion resiliently deforms the resilient locking pieces.

The preceding configuration also ensures that there is no possibility that the two housings are inclined with respect to each other when the two housings start being displaced toward the complete holding position and the resilient contact pieces are deformed resiliently.

The connector may further include a resilient contact piece formed on the waiting side housing. A contact portion may be formed on the resilient contact piece and may be configured to be held in contact with the edge of the mounting hole in the same direction as a displacing direction from the temporary holding position to the complete holding position with the waiting side housing located at the temporary holding position. A tapered surface may be formed on the contact portion, oblique to the displacing direction of the waiting side housing and configured to resiliently deform the resilient contact piece in a direction to separate the contact portion from the edge of the mounting hole by being pressed by the edge of the mounting hole.

According to this configuration, the waiting side housing is held reliably at the temporary holding position not only by the locking action of the locking portion of the resilient locking piece, but also by the contacting action of the contact portion of the resilient contact piece. If the two housings in the connected state are pressed toward the complete holding position, contact by the contact portion is released and the two housings are displaced to the complete holding position. Even if the resilient locking piece is not resiliently restored sufficiently to have a small locking margin of the locking portion when the two housings are returned to the temporary holding position, the waiting side housing can be held reliably at the temporary holding position by the contact portion of the resilient contact piece.

DETAILED DESCRIPTION

One specific embodiment of the invention is described with reference to FIGS. 1 to 13. Note that, in the following description, a right side in FIGS. 6 to 8 and 10 to 13 is defined as a front concerning a front-back direction. Upper and lower sides shown in FIGS. 1, 2 and 5 to 9 are defined as the top and bottom concerning a vertical direction.

A connector A of this embodiment is to be mounted on a panel P of a body of an automotive vehicle. A mounting hole H penetrates the panel P from the front to the rear thereof. The connector A includes a waiting side housing M to be held on the panel P in advance and a fit-in side housing F to be connected to the waiting side housing M from a front side of the panel P.

Figure 1:
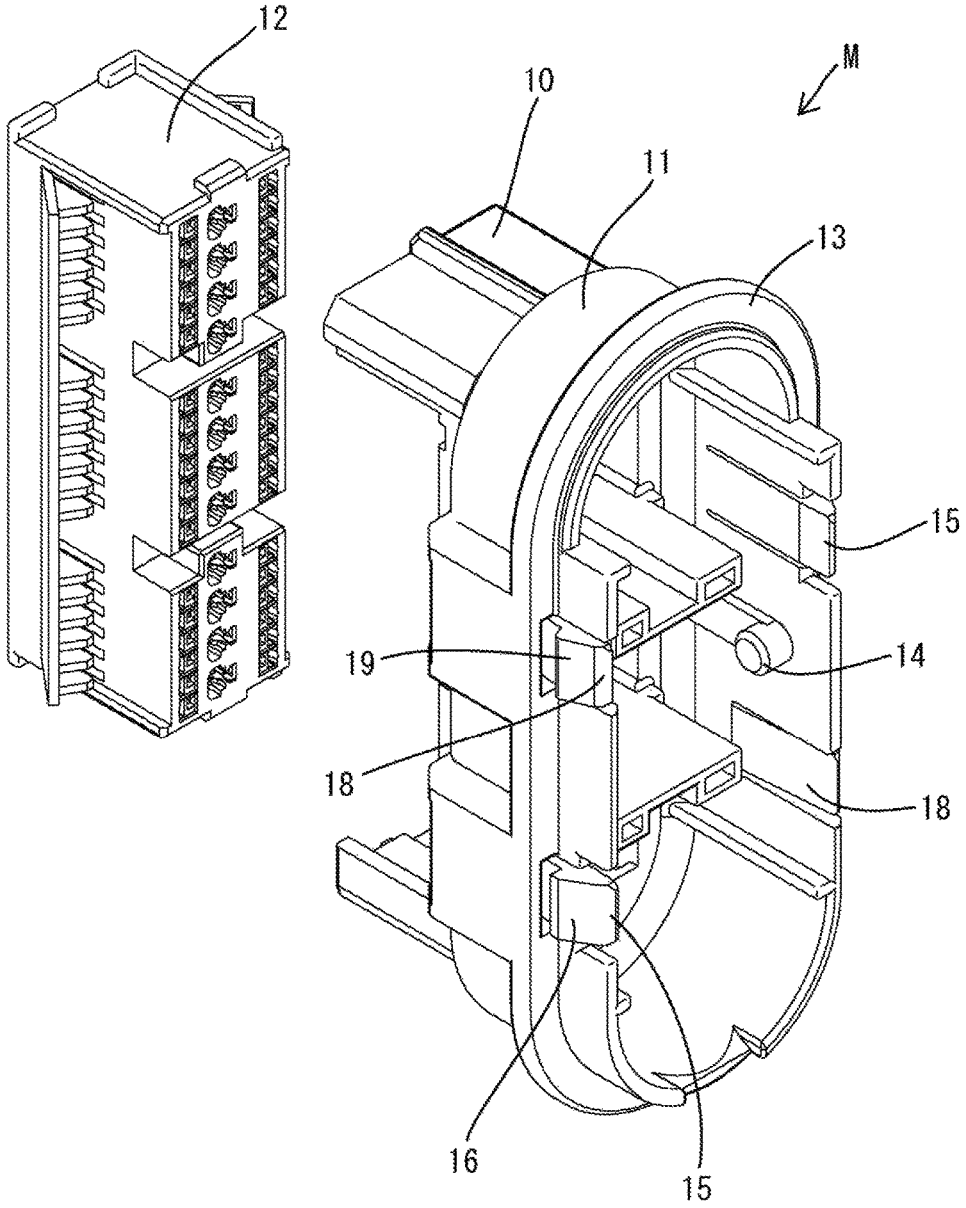
FIG. 1 is an exploded perspective view of a waiting side housing of a connector of one embodiment.

As shown in FIG. 1, the waiting side housing M includes a frame 10 made of synthetic resin. The frame 10 is formed with a forwardly projecting receptacle 11 that has a vertically long tubular shape. The waiting side housing M further has a sub-housing 12 made of synthetic resin and assembled with the frame 10 from behind. Male terminal fittings (not shown) are mounted into the sub-housing 12 and tabs on front end parts of the male terminal fittings are surrounded by the receptacle 11. A flange 13 is formed over the entire circumference on the outer periphery of a front end part of the receptacle 11 and projects like a rib. Two bilaterally symmetrical cam followers 14 project on the inner surfaces of left and right side walls of the receptacle 11.

Figure 2:
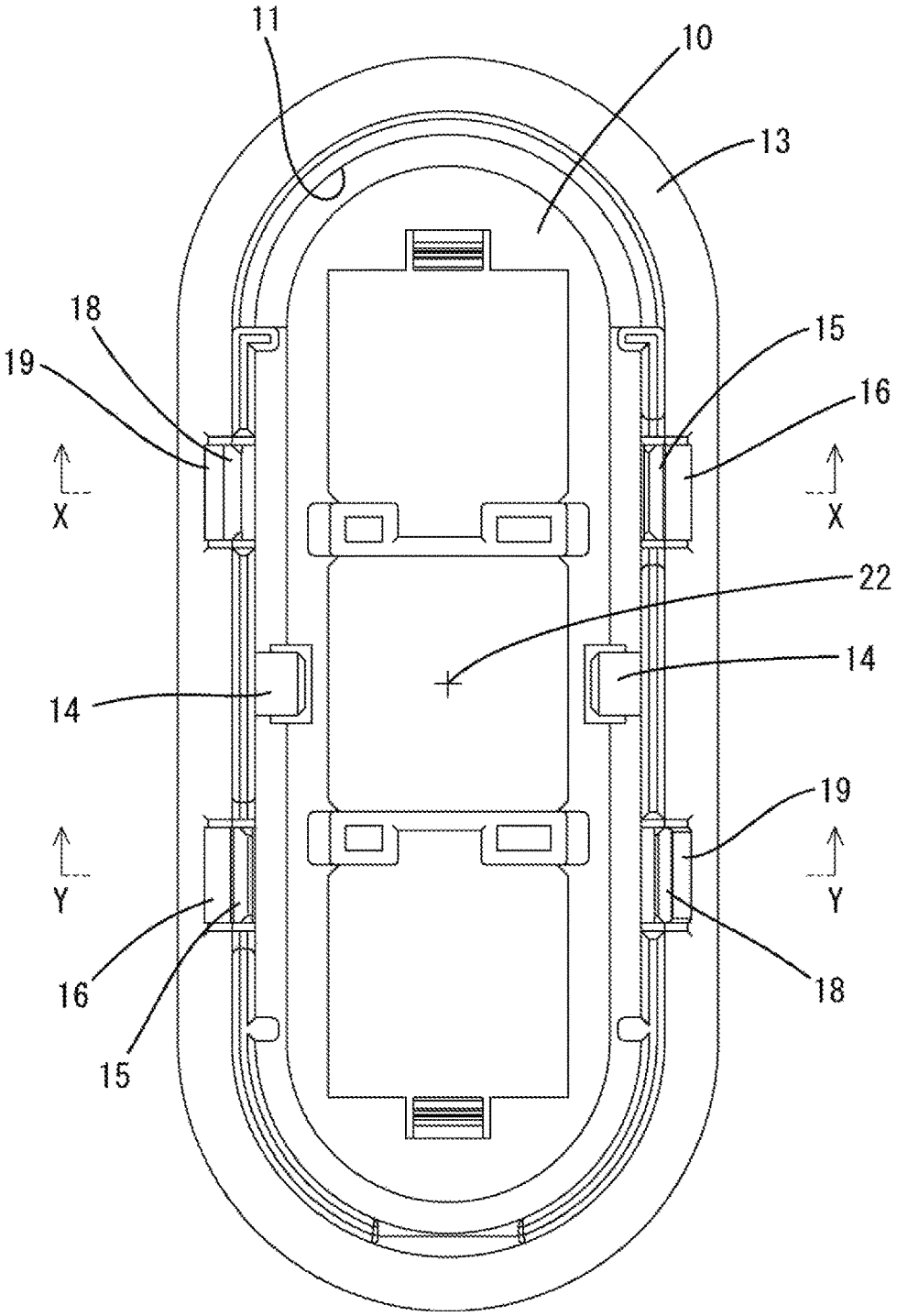
FIG. 2 is a front view of a frame of the waiting side housing.
Figure 3:
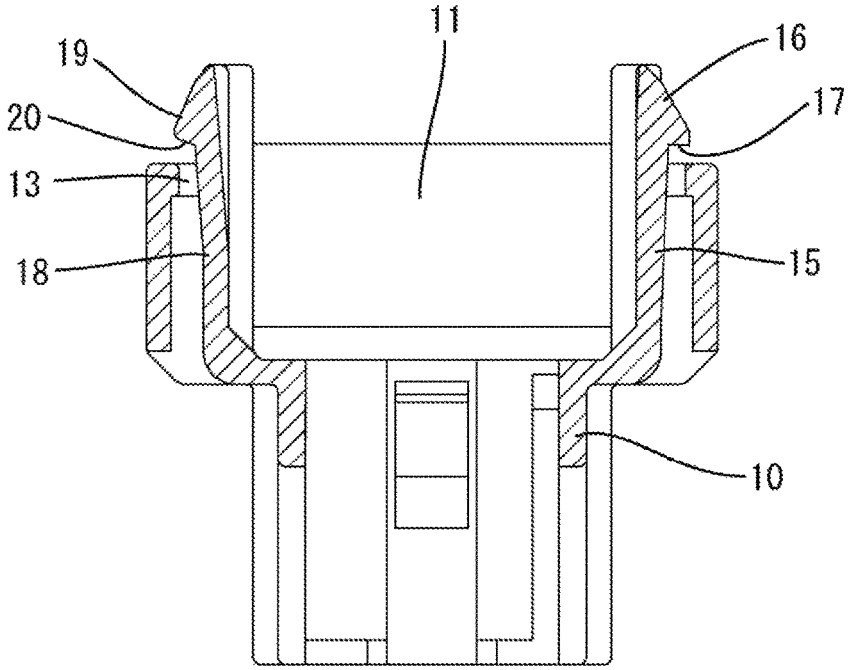
FIG. 3 is a section along X-X of FIG. 2.
Figure 4:
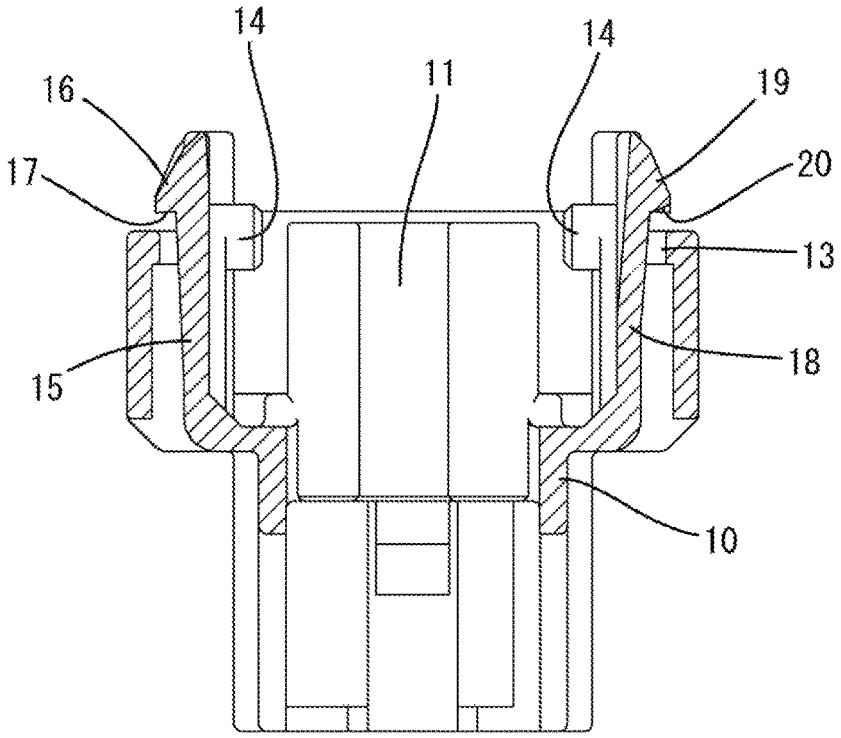
FIG. 4 is a section along Y-Y of FIG. 2.

As shown in FIGS. 1 to 3, two resilient locking pieces 15 and two resilient contact pieces 18 are formed on front end parts of the left and right side walls. The resilient locking pieces 15 are arranged point-symmetrically with respect to a virtual center axis 22 (see FIG. 2) that is parallel to a connecting direction of the two housings F, M and passes through a center of an opening area at the front end of the receptacle 11. The resilient locking pieces 15 are arranged respectively at a position above the virtual center axis 22 on one side wall and at a position below the virtual center axis 22 on the other side wall.

Similarly, the resilient contact pieces 18 also are arranged point-symmetrically with respect to the virtual center axis 22. The resilient contact pieces 18 are arranged respectively at a position below the virtual center axis 22 on one side wall and at a position above the virtual center axis 22 on the other side wall. The resilient locking piece 15 and the resilient contact piece 18 are vertically symmetrically arranged with respect to the virtual center axis 22 on each side wall.

Each resilient locking piece 15 is cantilevered forward and resiliently deformable in a lateral direction. A lock 16 is formed on a front end part of the resilient locking piece 15 and projects toward an outer peripheral side of the receptacle 11. The lock 16 is located slightly before the flange 13 and has a locking surface 17 substantially at a right angle to the connecting direction of the two housings F, M. An interval in the front-back direction between the locking surface 17 and the flange 13 is equal to or slightly larger than a thickness of the panel P.

Each resilient contact piece 18 also cantilevers forward and is resiliently deformable in the lateral direction. A contact portion 19 is formed on a front part of the resilient contact piece 18 and projects toward the outer peripheral side of the receptacle 11. The contact portion 19 is located slightly before the flange 13 and has a tapered surface 20 oblique to the connecting direction of the housings F, M. A direction of inclination of the tapered surface 20 is such that an interval in the front-back direction between the tapered surface 20 and the flange 13 increases in a projecting direction of the contact portion 19. A minimum interval in the front-back direction between the tapered surface 20 and the flange 13 equals or slightly exceeds the thickness of the panel P.

Figure 6:
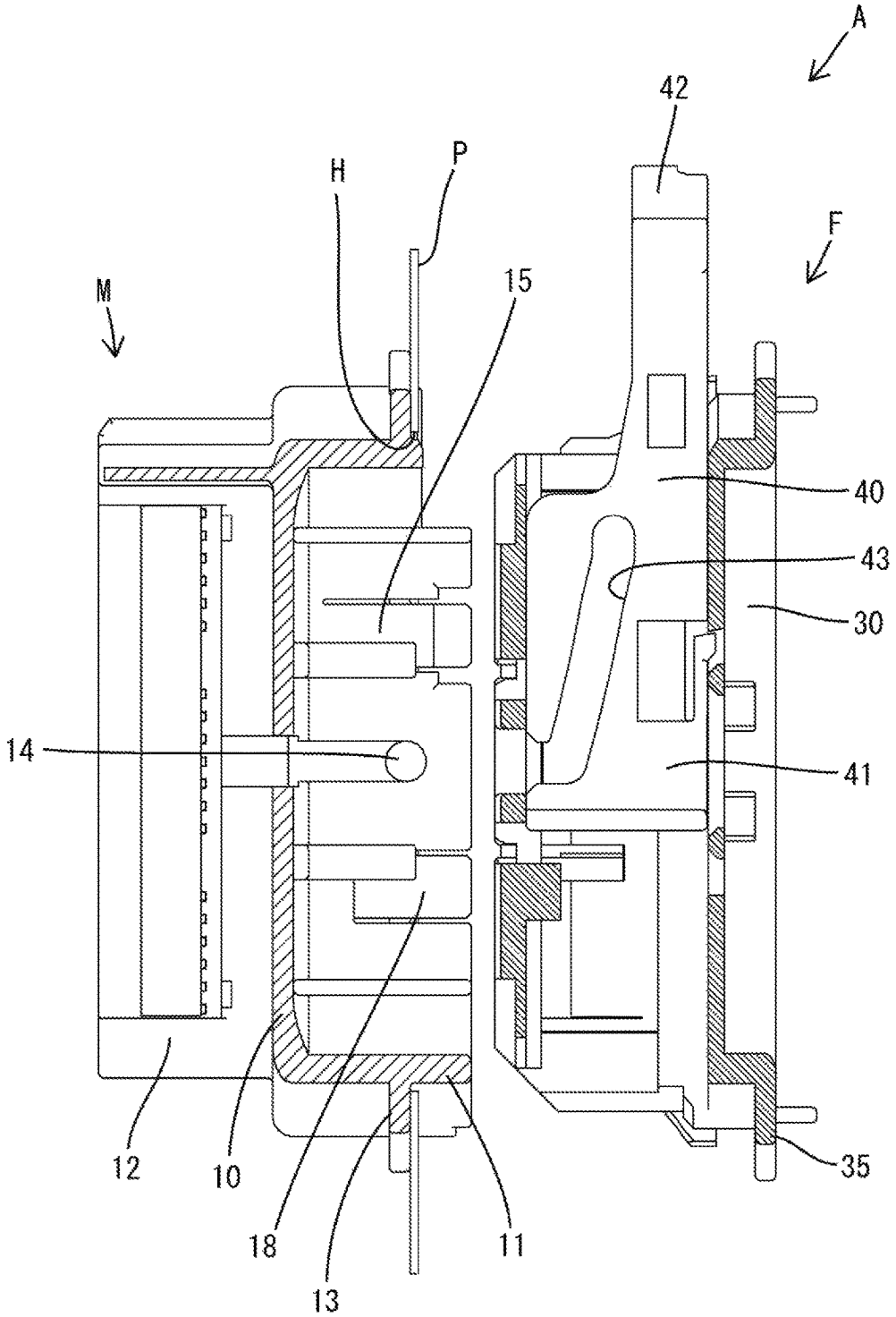
FIG. 6 is a side view partly in section showing a state immediately before the fit-in side housing is connected to the waiting side housing.
Figure 10:
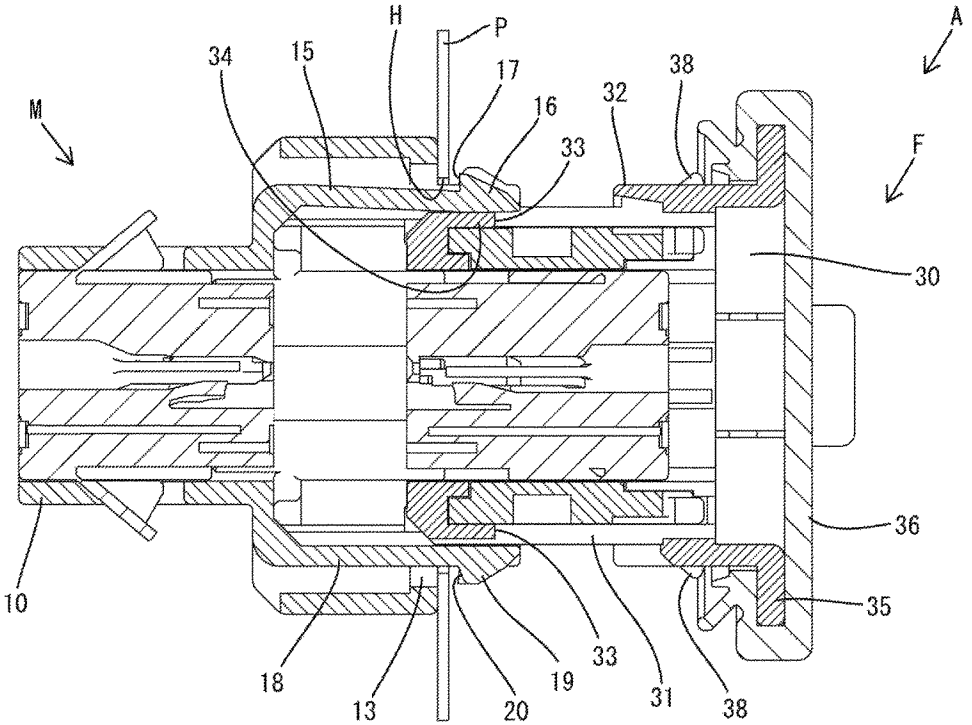
FIG. 10 is a section along Z-Z of FIG. 9.
Figure 11:
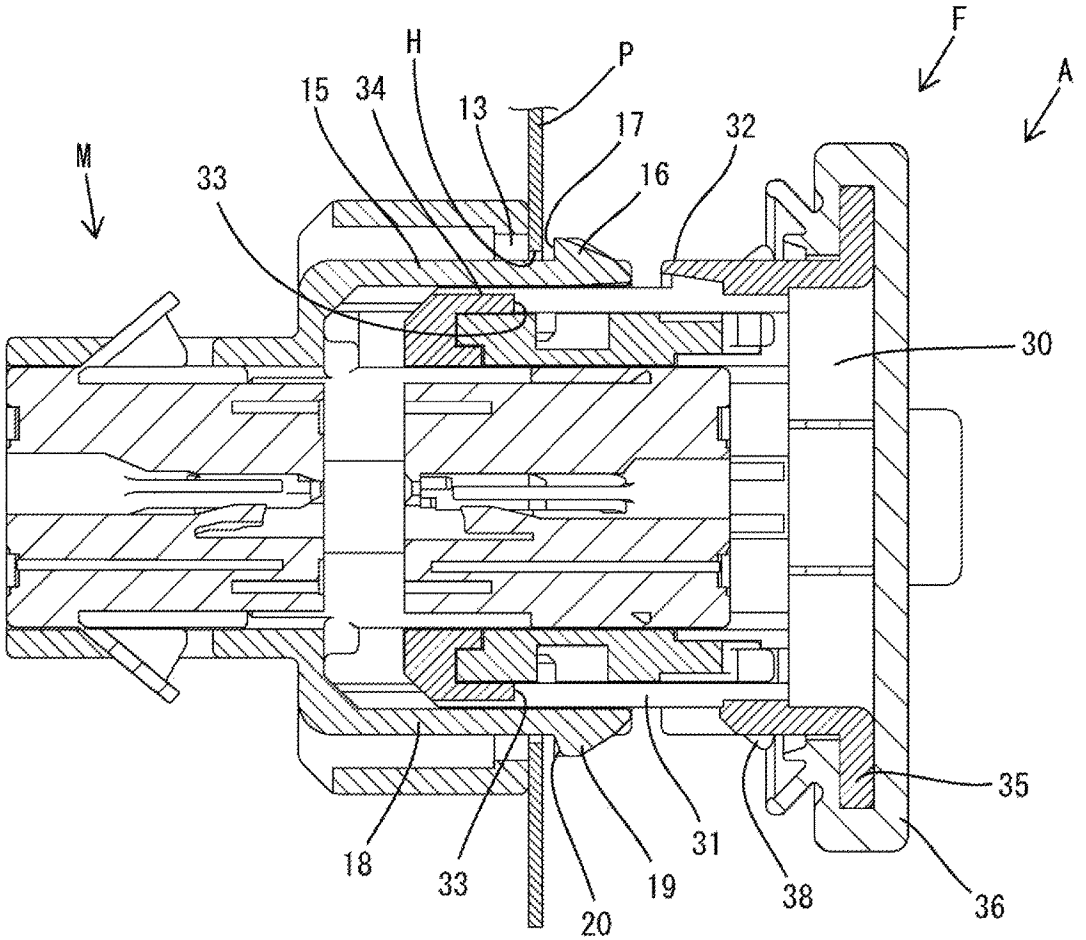
FIG. 11 is a section, corresponding to the one along Z-Z, showing a state where the fit-in side housing is lightly fitted in the receptacle of the waiting side housing.

The waiting side housing M is mounted on the panel P by inserting the receptacle 11 through the mounting hole H from a back side of the panel P before the two housings F, M are connected, as shown in FIG. 6. The flange 13 of the waiting side housing M that has been mounted on the panel P is in contact with the back surface of the panel P. Additionally, the locking surfaces 17 of the resilient locking pieces 15 are in contact with or in parallel facing relationship with the front surface of the panel P near the mounting hole H, as shown in FIG. 10. Thus, the panel P is sandwiched between the locking surfaces 17 and the flange 13 to hold the waiting side housing M reliably at a temporary holding position on the panel P, as shown in FIGS. 6, 7 and 10 to 12.

The tapered surfaces 20 of the resilient contact pieces 18 obliquely contact or proximately face the edge of the mounting hole H at the front surface of the panel P to define a semi-locking means. This semi-locking contacting action of the resilient contact pieces 18 further contributes to the reliable retention of the waiting side housing M at the temporary holding position on the panel P.

Figure 5:
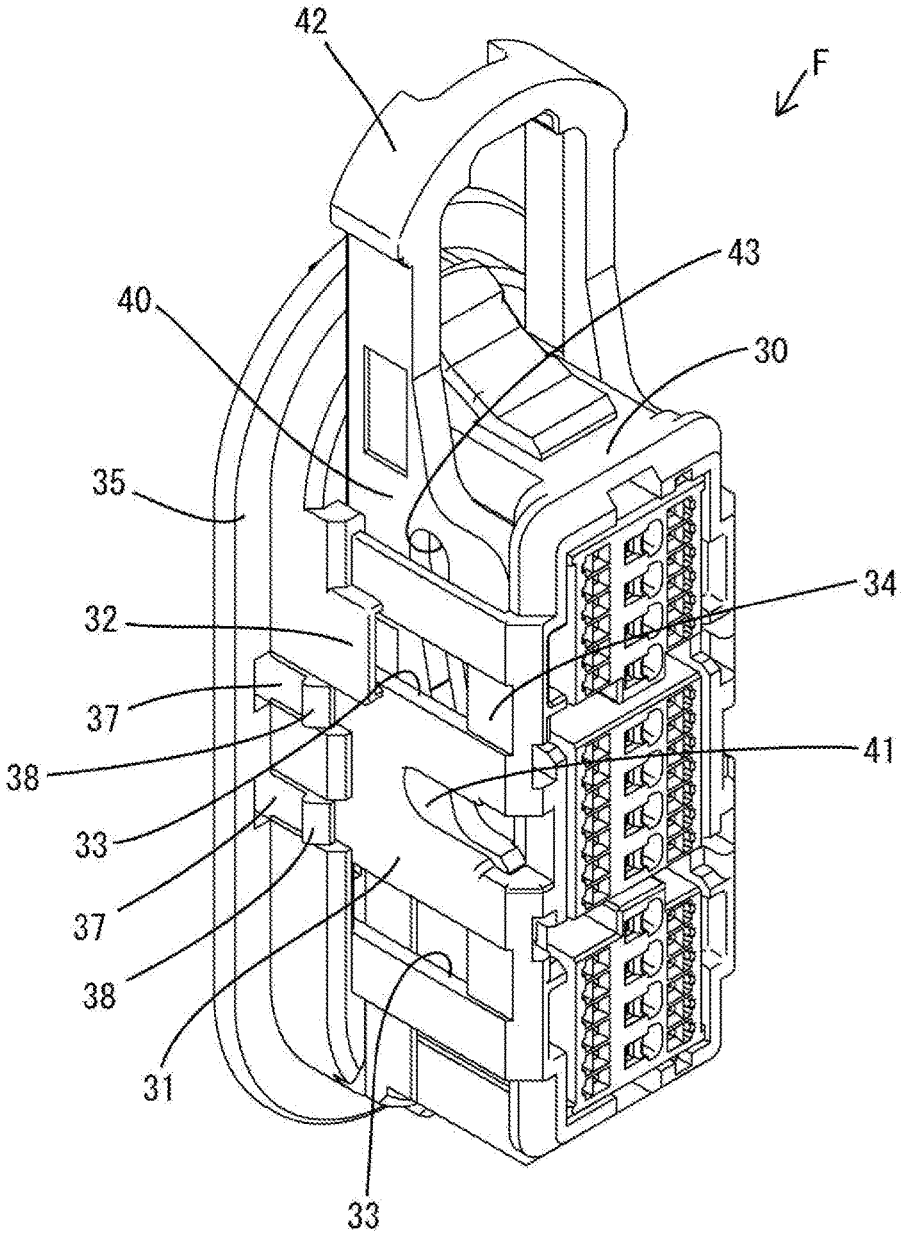
FIG. 5 is a perspective view of a fit-in side housing.
Figure 8:
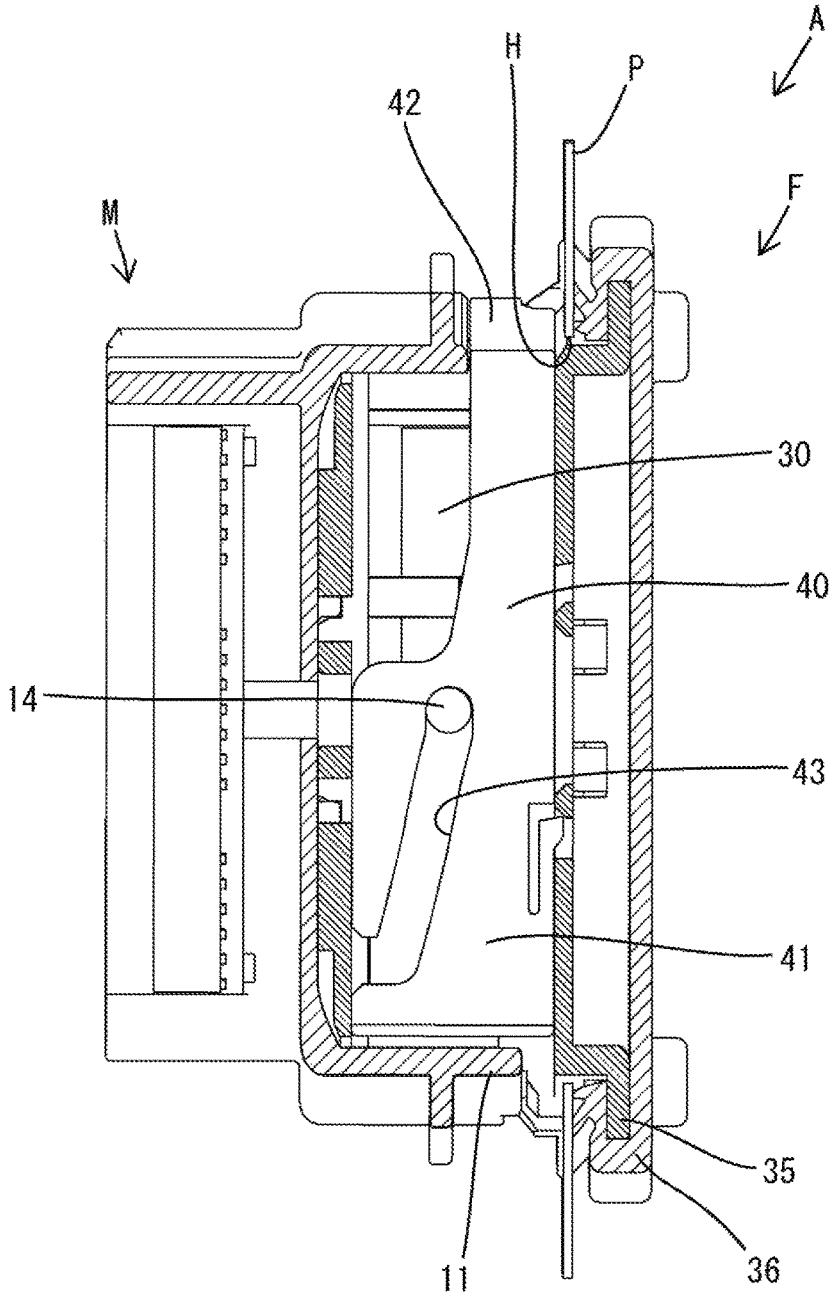
FIG. 8 is a side view partly in section showing a state where the waiting side housing and the fit-in side housing in a connected state are moved to a complete holding position.
Figure 9:
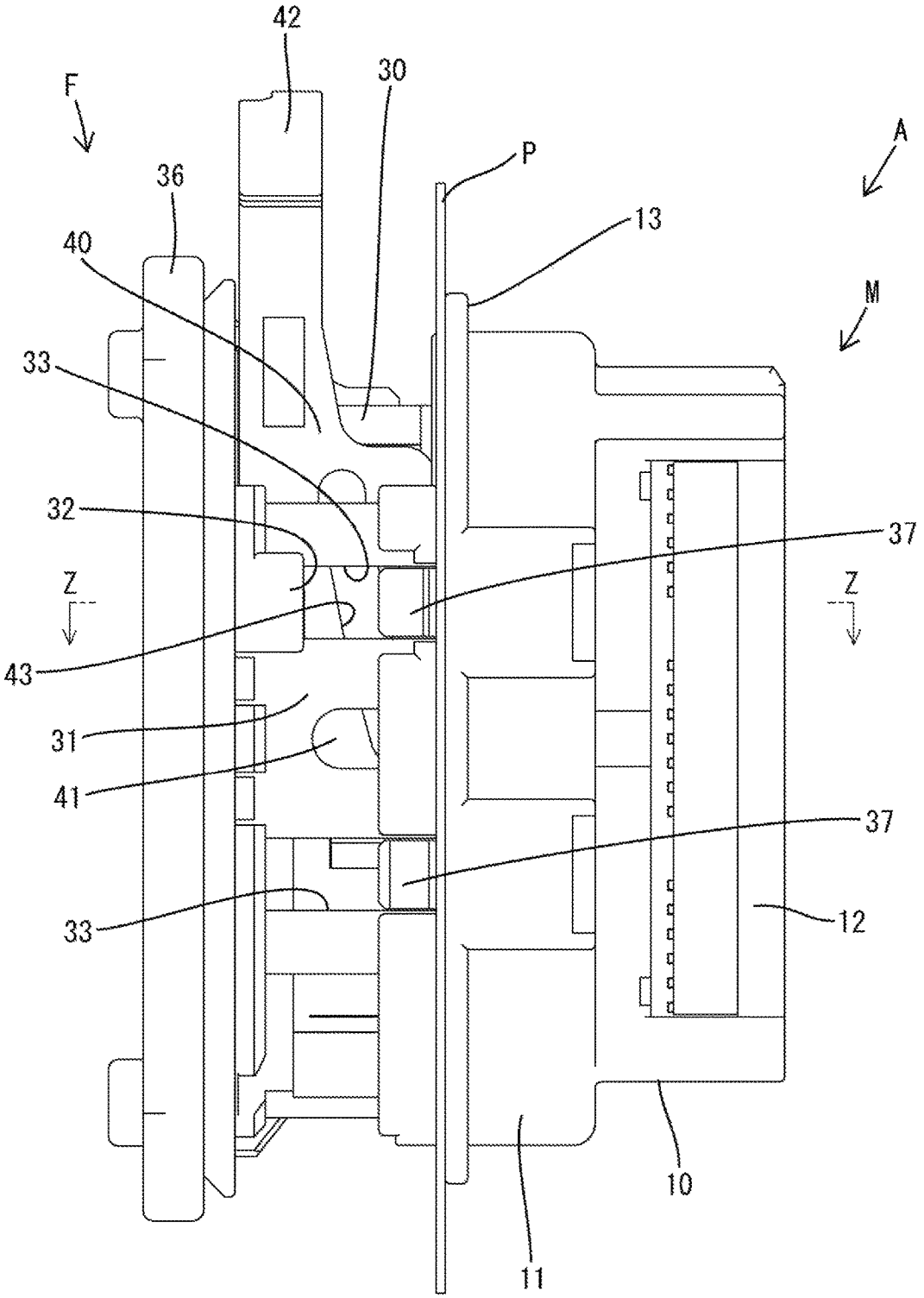
FIG. 9 is a side view showing a state while the fit-in side housing is being fitted into a receptacle of the waiting side housing.

As shown in FIGS. 5 and 9, the fit-in side housing F includes a housing body 30 and a slide lever 40 made of synthetic resin and relatively movable in the vertical direction between an initial position (see FIGS. 5, 6 and 9) and a connection position (see FIGS. 7 and 8) below the initial position with respect to the housing body 30. Female terminal fittings (not shown) are accommodated in the housing body 30. The fit-in side housing F is fit into the receptacle 11 by being brought closer to the waiting side housing M from the front side of the panel P.

Left and right guide walls 31 are formed on left and right outer side surfaces of the housing body 30 for movably guiding the slide lever 40. The guide walls 31 are formed respectively with left and right lock releasing portions 32. The lock releasing portions 32 are arranged at the same positions as the resilient locking pieces 15 in the vertical direction. The lock releasing portions 32 are arranged on rear end parts of the guide walls 31 in a fitting direction into the receptacle 11. The lock releasing portions 32 resiliently deform the resilient locking pieces 15 inward of the receptacle 11 immediately before proper connection of the two housings F, M is achieved so that the panel P is released from the locking of the locks 16.

Upper and lower interference avoiding holes 33 penetrate each guide wall 31 from the outer surface to the inner surface thereof. The interference avoiding holes 33 are arranged at the same positions as the resilient locking pieces 15 and the resilient contact pieces 18 in the vertical direction. The resiliently displaced resilient locking pieces 15 and resilient contact pieces 18 enter the interference avoiding holes 33 immediately before proper connection of the two housings F, M is achieved. Further, a pressing portion 34 is formed at the same position of the guide wall 31 as the resilient locking piece 15 in the vertical direction. The pressing portion 34 is arranged on a front end part of the guide wall 31 in the fitting direction into the receptacle 11.

The housing body 30 is formed with a holding rib 35, and a waterproof grommet 36 is mounted on the holding rib 35. The holding rib 35 and the grommet 36 are located behind the interference avoiding holes 33 in the fitting direction into the receptacle 11. Resiliently deformable complete holding locking pieces 37 are formed on left and right outer side surfaces of the housing body 30 and each has a locking projection 38. The complete holding locking pieces 37 are located before the holding rib 35 and the grommet 36 in the fitting direction into the receptacle 11.

The slide lever 40 includes left and right plate-like cam functioning portions 41 and an operating portion 42 that couples the upper ends of the cam functioning portions 41 and projects up from the cam functioning portions 41. The slide lever 40 is guided movably in the vertical direction between the initial position and the connection position by laying the cam functioning portions 41 along the guide walls 31. Each cam functioning portion 41 is formed with a cam groove 43 oblique to both the connecting direction of the two housings F, M (front-back direction) and a moving direction of the slide lever 40 (vertical direction).

The waiting side housing M is mounted on the panel P and held at the temporary holding position before starting the process of connecting the housings M, F. In this state, the fit-in side housing F is brought closer to the waiting side housing M from the front of the panel P and is fit lightly into the receptacle 11. Thus, the entrances of the cam grooves 43 are fit to the cam followers 14. The operating portion 42 then is pushed from above to move the slide lever 40 down. As the slide lever 40 moves, the cam followers 14 and the cam grooves 43 engage to exhibit a cam action and the fit-in side housing F is pulled to the back of the receptacle 11.

Figure 7:
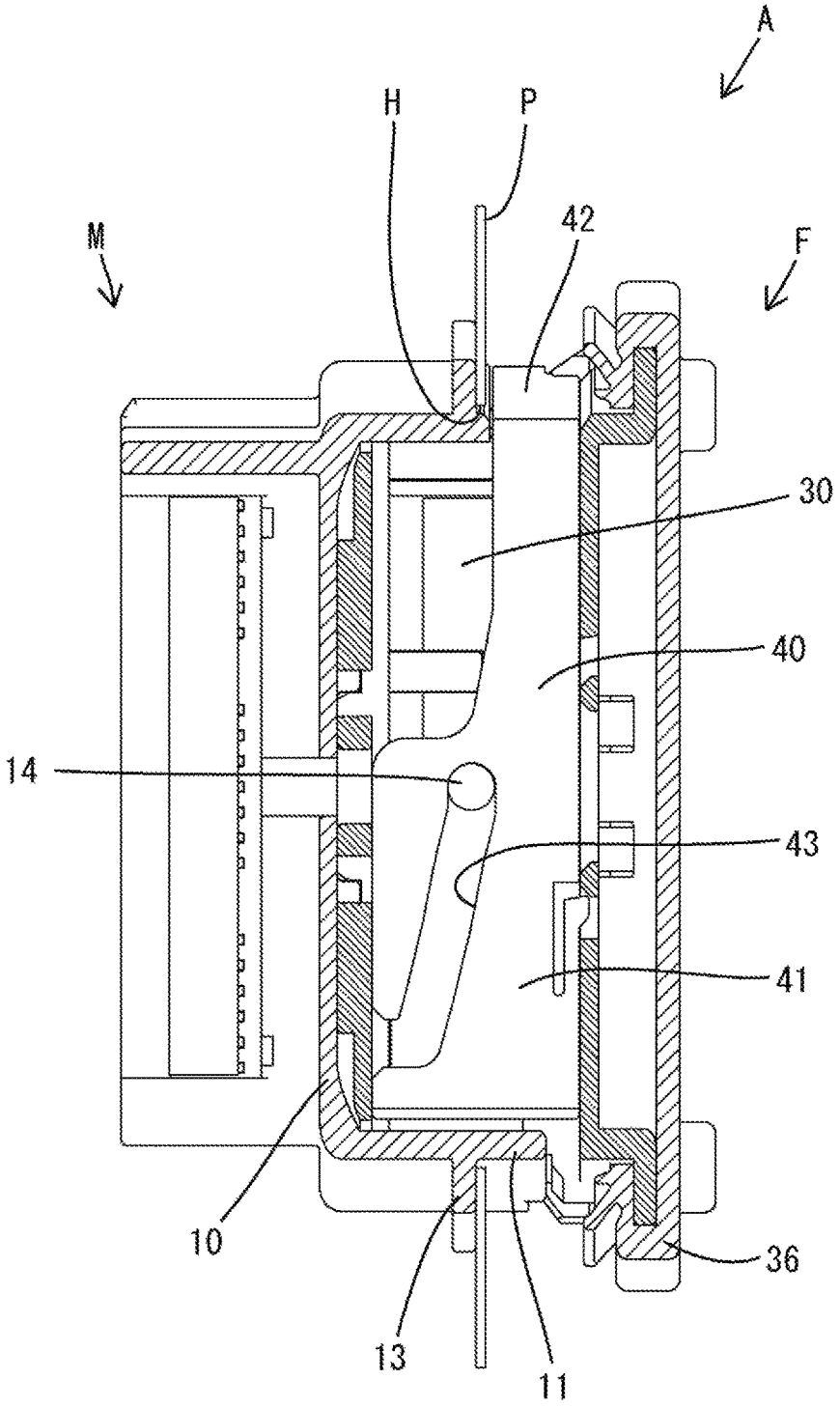
FIG. 7 is a side view partly in section showing a state where the waiting side housing and the fit-in side housing are properly connected and held at a temporary holding position.
Figure 12:
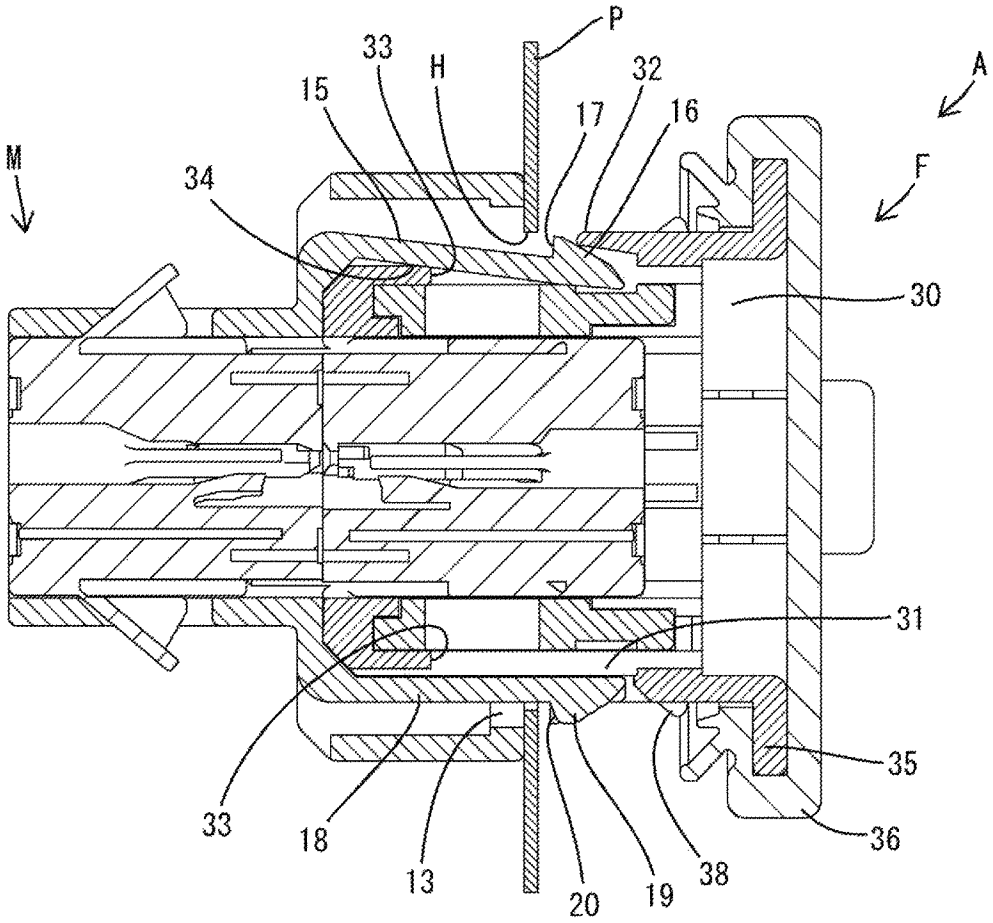
FIG. 12 is a section, corresponding to the one along Z-Z, showing the state where the waiting side housing and the fit-in side housing are connected properly and held at the temporary holding position.

The two housings F, M are connected properly when the slide lever 40 reaches the connection position and the lock releasing portions 32 resiliently deform the resilient locking pieces 15, as shown in FIGS. 7 and 12. The resiliently deformed resilient locking pieces 15 are separated from the panel P to lose their locking function, but the resilient contact pieces 18 are kept in contact with the panel P. Thus, the waiting side housing M continues to be held at the temporary holding position. The two housings F, M then are pushed toward the back from the front side of the panel P, and the resilient contact pieces 18 are deformed resiliently in directions away from the panel P by the inclination of the tapered surfaces 20. This causes the semi-locking by the resilient contact pieces 18 to be released, and the two housings F, M move to the back side of the panel P.

Figure 13:
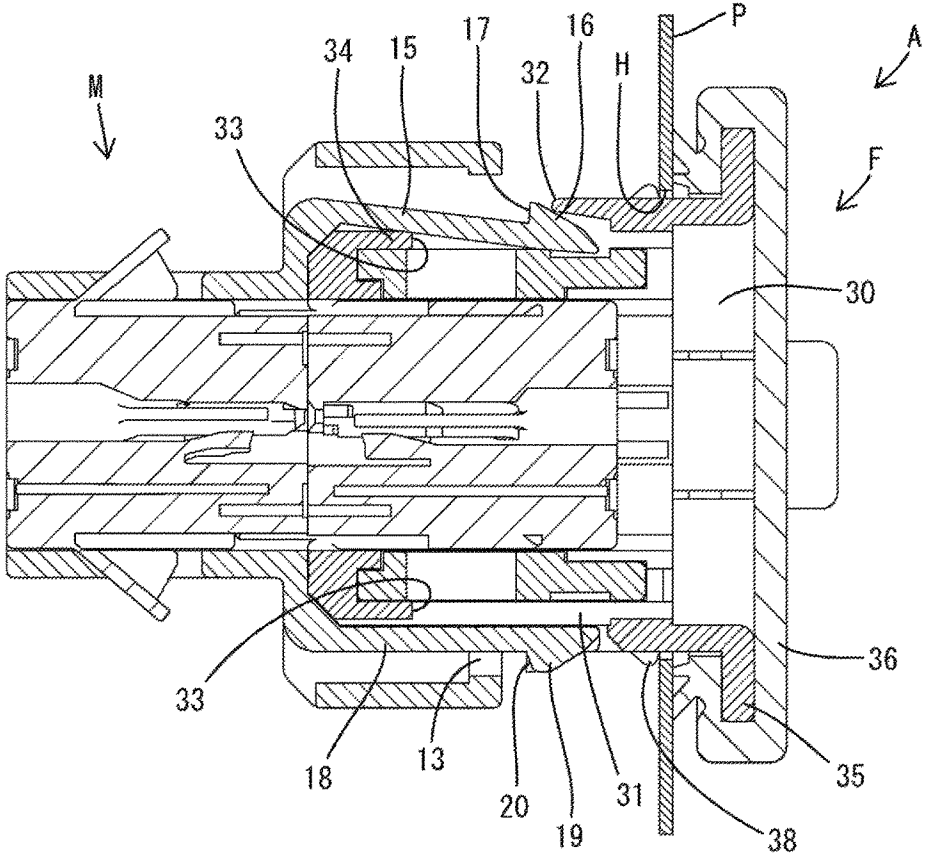
FIG. 13 is a section, corresponding to the one along Z-Z, showing the state where the waiting side housing and the fit-in side housing are moved to the complete holding position.

The waiting side housing M reaches the complete holding when the grommet 36 contacts the front surface of the panel P, as shown in FIGS. 8 and 13, and movements of the two housings F, M are restricted. At this time, the locking projections 38 of the complete holding locking pieces 37 have passed through the panel P and are locked to the panel P to sandwich the panel P resiliently between the locking projections 38 and the grommet 36. Thus, the waiting side housing M and the fit-in side housing F are held at the complete holding position with respect to the panel P. The grommet 36 is held in close contact with the front surface of the panel P to surround the mounting hole H with the two housings held at the complete holding position so that water cannot intrude into the mounting hole from the front side of the panel P.

The two housings F, M can be pulled toward the temporary holding position to separate the two housings F, M from the state held at the complete holding position. The complete holding locking pieces 37 are the semi-locking means so that the two housings F, M can be pulled back to the temporary holding position by applying a pulling force that exceeds a locking force of the complete holding locking pieces 37. Thereafter, the operating portion is pulled up to move the slide lever 40 to the initial position. Associated with this, the fit-in side housing F is pushed forward of the receptacle 11 by the cam action of the cam grooves 43 and the cam followers 14. Thereafter, the two housings F, M are separated by pulling the fit-in side housing F.

The lock releasing portions 32 keep the resilient locking pieces 15 resiliently deformed inward of the receptacle 11 when the housings F, M are connected properly. However, the resilient locking pieces 15 may not resiliently restore sufficiently when the two housings F, M are separated. Thus, the locks 16 may have insufficient locking margins with the panel P and the waiting side housing M may not be held reliably at the temporary holding position. However, the pressing portions 34 move along the inner surfaces of the resilient locking pieces 15 in the process of connecting the two housings F, M, as shown in FIG. 10. Thus, resilient locking pieces 15 that do not restore resiliently by sufficient amounts are pressed out by the pressing portions 34 and are restored reliably to ensure sufficient locking margins of the locks 16 with the panel P. Further, the contact portions 19 of the resilient contact pieces 18 are in contact with the panel P when the waiting side housing M is at the temporary holding position. Thus, the resilient contact pieces 18 exhibit a semi-locking function to hold the waiting side housing M reliably at the temporary holding position.

The connector A includes the waiting side housing M and the fit-in side housing F. The waiting side housing M is mounted to penetrate through the mounting hole H of the panel P and is displaceable between the temporary holding position and the complete holding position. The waiting side housing M is formed with the resilient locking pieces 15 and the resilient locking pieces 15 are formed with the locking portions 16. The locks 16 are locked to edges of the mounting hole H when the waiting side housing M is at the temporary holding position, thereby restricting displacement of the waiting side housing M toward the complete holding position.

The fit-in side housing F is connectable to the waiting side housing M and is formed with the lock releasing portions 32 for resiliently deforming the resilient locking pieces 15 when the two housings F, M are connected. The locks 16 separate from the edges of the mounting hole H when the resilient locking pieces 15 are deformed, and hence the resilient locking pieces 15 no longer temporarily hold the waiting side housing M. However, the waiting side housing M is formed with the resilient contact pieces 18 that include the contact portions 19. The contact portions 19 of the waiting side housing M that is at the temporary holding position are in contact with the edges of the mounting hole H in the same direction as a displacing direction from the temporary holding position to the complete holding position. Each contact portion 19 has the tapered surface 20 oblique to the displacing direction of the waiting side housing M. If the tapered surface 20 is pressed by the edge of the mounting hole H, the resilient contact piece 18 is deformed resiliently in a direction to separate the contact portion 19 from the edge of the mounting hole H.

According to the above configuration, the locking action of the locks 16 of the resilient locking pieces 15 and the contacting action of the contact portions 19 of the resilient contact pieces 18 reliably hold the waiting side housing M at the temporary holding position. The lock releasing portions 32 deform the resilient locking pieces 15 and release the locking by the locks 16 when the two housings F, M are connected. Contact by the contact portions 19 is released if the two housings F, M are pressed from this state toward the complete holding position, and this release enables the two housings F, M to be displaced to the complete holding position. The resilient locking pieces 15 may resiliently restore insufficiently so that the locks 16 may have small locking margins when the two housings F, M are returned to the temporary holding position. However, the contact portions 19 of the resilient contact pieces 18 reliably hold the waiting side housing M at the temporary holding position.

The fit-in side housing F is formed with the pressing portions 34. The pressing portions 34 press the resilient locking pieces 15 in directions to increase the locking margins of the locks 16 with edge areas of the mounting hole H when the lock releasing portions 32 do not interfere with the resilient locking pieces 15. The resilient locking pieces 15 may resiliently restore insufficiently when the housings F, M are returned to the temporary holding position. However, the pressing portions 34 press the resilient locking pieces 15 in the process of separating the fit-in side housing F from the waiting side housing M and increase the locking margins of the locks 16 with the edge areas of the mounting hole H. Thus, the waiting side housing M is held reliably at the temporary holding position.

The waiting side housing M is mounted to penetrate through the mounting hole H of the panel P and is displaceable between the temporary holding position and the complete holding position. The waiting side housing M is formed with the resilient locking pieces 15 and the resilient locking pieces 15 are formed with the locks 16. With the waiting side housing M located at the temporary holding position, the locks 16 are locked to edges of the mounting hole H, thereby restricting a displacement of the waiting side housing M toward the complete holding position.

The fit-in side housing F is connectable to the waiting side housing M and is formed with the lock releasing portions 32 for resiliently deforming the resilient locking pieces 15 when the two housings F, M are connected. The locks 16 are separated from edge areas of the mounting hole H when the resilient locking pieces 15 are deformed resiliently, and thus the resilient locking pieces 15 no longer temporarily hold the waiting side housing M. However, the fit-in side housing F has the pressing portions 34 that press the resilient locking pieces 15 in directions to increase the locking margins of the locks 16 with edge areas of the mounting hole H in a state where the lock releasing portions 32 are not interfering with the resilient locking pieces 15.

According to this configuration, the waiting side housing M is held at the temporary holding position by the locking action of the locks 16 of the resilient locking pieces 15. When the two housings F, M are connected, the lock releasing portions 32 deform the resilient locking pieces 15 and release locking by the locks 16. Thus, the two housings F, M can be pressed toward and to the complete holding position. The resilient locking pieces 15 may resiliently restore insufficiently when the two housings F, M are returned to the temporary holding position. However, the pressing portions 34 press the resilient locking pieces 15 in the process of separating the fit-in side housing F from the waiting side housing M and increase the locking margins of the locking portions 16 with areas near the edge of the mounting hole H. Thus, the waiting side housing M is held reliably at the temporary holding position.

The waiting side housing M has the resilient contact pieces 18 that are formed with the contact portions 19. With the waiting side housing M at the temporary holding position, the contact portions 19 contact edge areas of the mounting hole H in the same direction as the displacing direction from the temporary holding position to the complete holding position. Each contact portion 19 has the tapered surface 20 that is oblique to the displacing direction of the waiting side housing M. The edge area of the mounting hole H presses the tapered surfaces 20 so that the resilient contact pieces 18 deform in a direction to separate the contact portions 19 from the edges of the mounting hole H. Accordingly, the waiting side housing M is held reliably at the temporary holding position by the locking action of the locks 16 of the resilient locking pieces 15 and also by the contacting action of the contact portions 19 of the resilient contact pieces 18. The two housings F, M that are in this connected state can be pressed toward the complete holding position, and this pressing releases contact by the contact portions 19 so that the two housings F, M can be displaced to the complete holding position. The resilient locking pieces 15 may not resiliently restored sufficiently, and the locks 16 may have only small locking margins when the two housings F, M are returned to the temporary holding position. However, the contact portions 19 of the resilient contact pieces 18 reliably hold the waiting side housing M at the temporary holding position.

The two resilient locking pieces 15 are arranged at the positions point-symmetrical with respect to the virtual center axis 22 parallel to the connecting direction of the two housings F, M. Thus, the two housings F, M will not inclined with respect to each other when the lock releasing portions 32 resiliently deform the resilient locking pieces 15. Further, the resilient contact pieces 18 are at the positions point-symmetrical with respect to the virtual center axis 22 parallel to the connecting direction of the two housings F, M. Thus, the two housings F, M will not incline with respect to each other when the two housings F, M start being displaced toward the complete holding position and the resilient contact pieces 18 are deformed resiliently.

The invention is not limited to the above described embodiment, and the following embodiments are also included in the scope of the invention.

Although the resilient locking pieces are arranged point-symmetrically arranged with respect to the virtual center axis parallel to the connecting direction of the two housings in the above embodiment, the resilient locking pieces may be point-asymmetrically arranged. In this case, the resilient locking pieces may be line-symmetrically arranged or line-asymmetrically arranged.

Although the resilient contact pieces are point-symmetrically arranged with respect to the virtual center axis parallel to the connecting direction of the two housings in the above embodiment, the resilient contact pieces may be point-asymmetrically arranged. In this case, the resilient locking pieces may be line-symmetrically arranged or line-asymmetrically arranged.

Although two resilient locking pieces are provided in the above embodiment, one, three or more resilient locking pieces may be provided.

Although two resilient contact pieces are provided in the above embodiment, one, three or more resilient contact pieces may be provided.

The fit-in side housing is formed with the pressing portions for resiliently restoring the resilient locking pieces in the above embodiment. However, the fit-in side housing may not be formed with the pressing portions in the first aspect of the invention.

The waiting side housing has the resilient contact pieces in the above embodiment. However, the waiting side housing may not be have the resilient contact pieces.

LIST OF REFERENCE SIGNS

A . . . connector
F . . . fitting-side housing
H . . . mounting hole
M . . . waiting side housing
P . . . panel
15 . . . resilient locking piece
16 . . . lock
18 . . . resilient contact piece
19 . . . contact portion
20 . . . tapered surface
22 . . . virtual center axis
32 . . . lock releasing portion
34 . . . pressing portion

What is claimed is:

1. A connector, comprising:

a waiting side housing to be mounted to penetrate through a mounting hole of a panel and displaceable in a displacing direction between a temporary holding position and a complete holding position;

a resilient locking piece formed on the waiting side housing;

a lock formed on the resilient locking piece and configured to restrict a displacement of the waiting side housing toward the complete holding position by being locked to an edge part of the mounting hole with the waiting side housing at the temporary holding position and separate from the edge part of the mounting hole (H) only by resilient deformation of the resilient locking piece;

a resilient contact piece formed on the waiting side housing;

a contact portion formed on the resilient contact piece and configured to be held in contact with the edge part of the mounting hole in the same direction as a displacing direction from the temporary holding position to the complete holding position with the waiting side housing located at the temporary holding position;

a tapered surface formed on the contact portion, oblique to the displacing direction of the waiting side housing and configured to resiliently deform the resilient contact piece in a direction to separate the contact portion from the edge part of the mounting hole by being pressed by the edge part of the mounting hole;

a fit-in side housing connectable to the waiting side housing; and a lock releasing portion formed on the fit-in side housing and configured to deform the resilient locking piece when the fit-in side housing is connected to the waiting side housing.

2. The connector of claim 1, further comprising at least one pressing portion formed on the fit-in housing and capable of pressing the resilient locking piece in a direction to increase a locking margin of the lock with the edge part of the mounting hole in a state where the lock releasing portion is not interfering with the resilient locking piece.

3. The connector of claim 2, wherein a plurality of resilient locking pieces are arranged at positions point-symmetrical with respect to a virtual center axis parallel to a connecting direction of the waiting side housing and the fit-in side housing.

4. The connector of claim 3, wherein a plurality of resilient contact pieces are arranged at positions point-symmetrical with respect to a virtual center axis parallel to a connecting direction of the waiting side housing and the fit-in side housing.

* * * * *